US005947349A

United States Patent [19]

Shaalan

[11] Patent Number: 5,947,349

[45] Date of Patent: Sep. 7, 1999

[54] GARMENT FOLDING APPARATUS AND METHOD

[76] Inventor: Linda Shaalan, 3614 Orchard Lake Rd., West Bloomfield, Mich. 48324

[21] Appl. No.: 08/094,748

[22] Filed: Jul. 22, 1993

[51] Int. Cl.[6] ..... A41H 33/00

[52] U.S. Cl. ..... 223/37; 223/38; 223/87

[58] Field of Search ..... 223/85, 87, 95, 223/92, 37, 38

[56] References Cited

U.S. PATENT DOCUMENTS

| | | | |
|---|---|---|---|
| 1,213,569 | 1/1917 | Wordingham | 223/87 |
| 1,251,461 | 1/1918 | Bachmann | 223/37 |
| 1,375,808 | 4/1921 | Witbeck | 223/95 |
| 3,398,839 | 8/1968 | Ballenger et al. | 233/87 |
| 3,837,544 | 9/1974 | Greenwald | 223/87 |
| 3,984,002 | 10/1976 | Howard | 223/87 |
| 4,944,417 | 7/1990 | Datlow | 223/87 |
| 5,011,052 | 4/1991 | Craig | 223/37 |
| 5,131,574 | 7/1992 | Usco et al. | 223/37 |
| 5,154,329 | 10/1992 | Dorfmueller | 223/87 |
| 5,174,479 | 12/1992 | Dufour | 223/37 |

*Primary Examiner*—Bibhu Mohanty

*Attorney, Agent, or Firm*—Weiner & Burt, P.C.; Irving M. Weiner; Pamela S. Burt

[57] ABSTRACT

A garment folding apparatus and method which facilitates the neat and uniform folding of garments such as shirts and the like. The apparatus has a simplified structure including a substantially rigid main body portion which serves as a folding guide, and an upper supporting portion which facilitates storage and handling of the apparatus. The apparatus may be fabricated of a thermoplastic material such as acrylic, or alternatively the main body portion may be formed of aromatic cedar while the supporting portion is formed of metal. In use, the apparatus is removed from the folded garment after folding operations are complete, so that it may be re-used time and again.

19 Claims, 1 Drawing Sheet

GARMENT FOLDING APPARATUS AND METHOD

BACKGROUND OF THE INVENTION

1. Field of the Invention

The present invention relates generally to a garment folding apparatus and method which assists the user in neatly folding garments after cleaning, for storage, and the like. More particularly, the invention relates to a garment folding apparatus which enables the user to fold a garment neatly and uniformly without undesirable wrinkles or creases. After the garment is suitably folded, the apparatus is removed so as to leave a uniformly-folded garment.

2. Description of Relevant Art

The neat and uniform folding of garments after they have been cleaned, for stacking on retail store shelves or displays, and/or for storage, is critical to the prevention of wrinkling and creasing. A properly folded garment not only reduces or eliminates ironing, it permits neat and orderly storage or display of garments. Neatly and uniformly folded garments are desired not only by homemakers doing laundry, but also by those in the cleaning industry, retail garment establishments, and the like.

Heretofore, the neat and uniform folding of garments has proven to be a relatively difficult and tedious operation to accomplish. In folding a garment such as a shirt, for example, painstaking care, patience and time is required for proper folding without undesirable wrinkles or creases. This problem becomes particularly acute where a large number of garments are to be folded after laundering or dry cleaning, or when they are to be stacked for display in a store.

Various known devices have been provided for assisting the user in folding garments such as shirts or the like. Generally, however, such devices have been relatively complicated both in structure and in use. The following patents disclose exemplary devices of this nature.

U.S. Pat. No. 1,565,621 issued in 1925 to Cahn discloses a three-part garment wrapping and hanging form including a vertical stand which pivotally supports a wrapping board provided with a removable hanger which supports a garment as it is being wrapped on the board. A similar three-part arrangement is disclosed in U.S. Pat. No. 1,572,703 issued in 1926 to Cahn. U.S. Pat. No. 3,989,172 issued in 1976 to Wiedemann et al discloses a stiffening panel about which a shirt is folded, the panel having a projection for pushing under a shirt collar and a slit for receiving a shirt sleeve, thus eliminating the need for pins. U.S. Pat. No. 5,131,574 issued in 1992 to Usco et al discloses a shirt-folding device including a plate hingedly connected to a frame having locking pieces. A shirt is folded around the plate while the frame and locking pieces hold it in position against the plate, after which the entire device is removed from the folded shirt.

The present invention overcomes the problems associated with such known devices by providing a garment folding apparatus which is simplified in structure and very convenient to use. Further, the invention enables a user to fold garments considerably more neatly and uniformly than is possible without the apparatus. The apparatus is removed from the folded garment after folding operations are complete, so that it is very inexpensive to use inasmuch as it can be used time and again to fold large numbers of garments.

SUMMARY OF THE INVENTION

The invention provides a garment folding apparatus comprising a main body portion shaped and dimensioned to conform to a desired folded dimension of a garment to be folded, the main body portion being fabricated of a substantially rigid material. Means for supporting the apparatus extends from an upper end of the main body portion. The apparatus is adapted to be removed from the garment after folding operations are complete by pulling the apparatus free from the folded garment.

In a preferred embodiment, the garment to be folded comprises a shirt and the main body portion has a substantially rectangular, flat shape. The supporting means comprises a hook-shaped member for hanging the apparatus from a rod or the like, and which permits convenient handling of the apparatus. The main body portion and the supporting means may be integrally molded of a thermoplastic material. Alternatively, the main body portion may be fabricated of wood, such as aromatic cedar, and the supporting means may be fabricated of metal.

It is an object of the invention to provide a garment folding apparatus and method which facilitates neat and uniform folding of a garment, particularly a shirt, while eliminating wrinkles and creases.

A further object of the invention is to provide a garment folding apparatus which is removed from the garment after folding operations are complete, so that the apparatus may be repeatedly used for folding a large number of garments.

Yet another object of the invention is to provide a garment folding apparatus having a simplified structure which is economical to produce.

The above and further objects, details and advantages of the invention will become apparent from the following detailed description, when read in conjunction with the accompanying drawings.

DETAILED DESCRIPTION OF PREFERRED EMBODIMENTS

Figure 3:
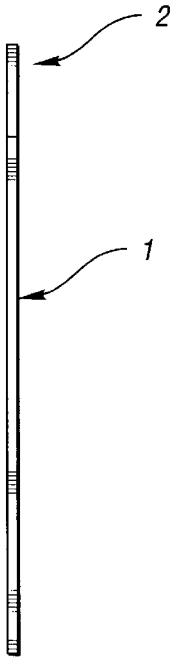
FIG. 3 is a side elevational view of the apparatus of FIG. 1.
Figure 4:
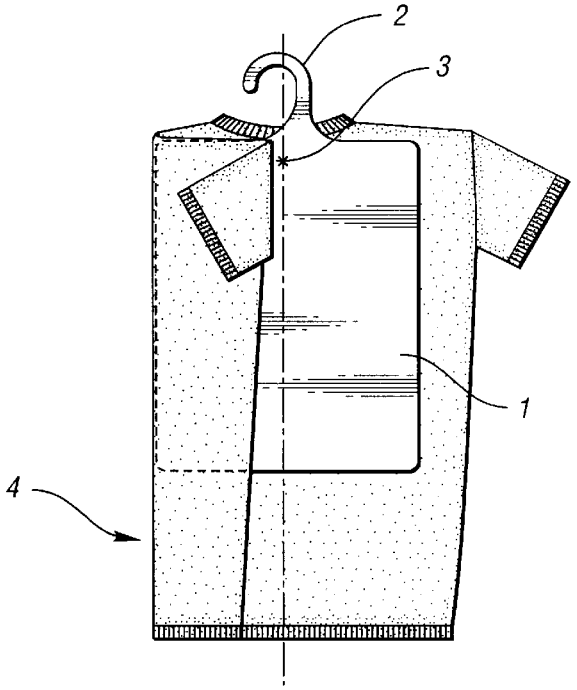
FIG. 4 shows the apparatus according to the invention in use, in position upon a shirt to be folded.

A first embodiment of the garment folding apparatus according to the invention will be described with reference to FIGS. 1, 3 and 4.

Figure 1:
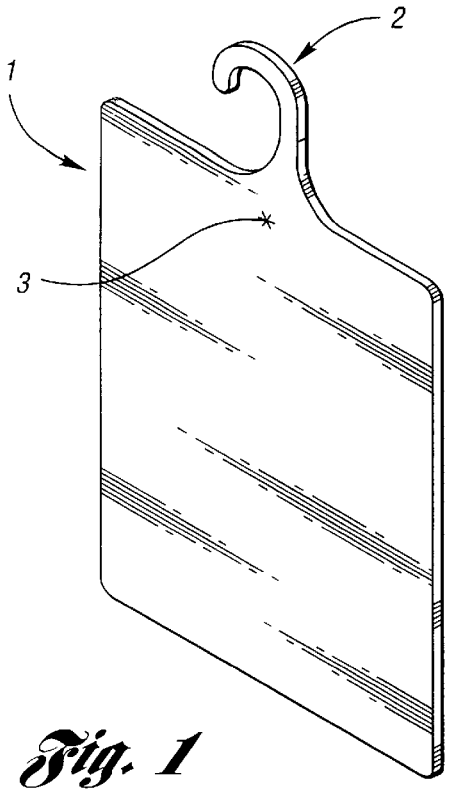
FIG. 1 is a perspective view of a garment folding apparatus in accordance with a first embodiment of the invention.

As shown in FIG. 1, the garment folding apparatus comprises a main body portion 1 and an upper supporting portion 2. The main body portion has a substantially flat rectangular shape, and is fabricated of a substantially rigid material. The dimensions of the main body portion 1 preferably conform to the desired folded dimensions of a garment to be folded, such as a shirt. By way of example, the main body portion may have a width dimension of substantially 9½ inches, a length dimension of substantially 12 inches, and a thickness of substantially ⅛ inch. It will be understood, however, that such dimensions can be increased or decreased as desired, to accommodate different sizes of garments to be folded. It is further contemplated that the flat rectangular shape of main body portion 1 can be modified as desired to accommodate garments of various shapes.

The supporting portion 2 may preferably be substantially hook-shaped as shown, resembling the shape of the hooked portion of a conventional clothes hanger. Preferably, the distance from the top edge of main body portion 1 to the upper edge of supporting portion 2 would be approximately 3 inches. The supporting portion 2 may be used for hanging the apparatus from a rod, hook, or the like, and is also useful for carrying the apparatus, and/or for handling it during use.

The apparatus of FIG. 1, including both the main body portion 1 and the supporting portion 2, may desirably be integrally molded of a thermoplastic material, such as a clear acrylic material. It will be understood, however, that the invention is in no manner limited to such material. Any suitable material which is substantially rigid in its final state may be used for fabricating the apparatus.

To aid in centering the apparatus during use, as will be described in greater detail below, a centering mark 3 or similar indicia may desirably be provided on main body portion 1. It is contemplated that the main body portion 1 may also be marked with other indicia, such as folding guide lines or similar marks, advertising material, and/or instructions for using the device. To enhance the aesthetic appearance of the apparatus, it may also be desired to provide decorative markings on main body portion 1 and/or supporting portion 2, and to fabricate the apparatus of thermoplastic material of various desired colors.

Preferred methods of using the apparatus of FIG. 1 for folding garments will now be described with reference to FIG. 4. By way of example, a shirt 4 to be folded may first be laid out on a substantially horizontal surface. Depending on the material and style of the shirt, the user may wish to smooth the shirt at this initial stage if necessary to remove undesirable wrinkles or creases. The apparatus of the invention is then placed on the shirt 4 such that the upper supporting portion 2 projects somewhat above the neck or collar portion of the shirt. To ensure that the apparatus is properly centered on shirt 4, the user may use the centering mark 3 by aligning same with the center of the shirt.

Once the apparatus has been properly centered on the garment as described, the user is ready to begin folding operations. Where the garment to be folded is a shirt 4, such as shown in FIG. 4, the user first folds one lengthwise side portion of the shirt over the corresponding lengthwise side portion of main body portion 1 of the apparatus. Although the left side of shirt 4 is shown in FIG. 4 as being the first side to be folded, it will be understood that the user may just as readily choose to fold the right side first. Once the first side portion has been folded, the user may then fold back the sleeve as shown in FIG. 4. Where the shirt or other garment has long sleeves, the sleeve may be fan folded or lengthwise folded, as desired.

After the first side portion and sleeve have been folded as described above, the user then repeats the same operations for the other side of the shirt. When both sides of the shirt and the respective sleeves have been folded around main body portion 1, the user then folds the lower portion of the shirt extending below main body portion 1 upwardly, bringing the bottom of the shirt towards the neck. The lower portion of the shirt will thus be folded over the folded side portions and sleeves so as to lay thereon, and folding operations are complete. The user then removes the apparatus from the folded garment merely by sliding it upwardly, by grasping either supporting portion 2 and/or an upper portion of main body portion 1. The apparatus may then be conveniently stored by hanging supporting portion 2 on a rod, hook, clothesline, or the like, or by alternatively laying the apparatus flat in a drawer or on a shelf.

It will be understood that throughout each of the folding steps described above, the main body portion 1, which is substantially rigid, serves as a guide for neatly and uniformly folding the garment. After or during each folding step, it is desirable to smooth out any wrinkles and/or creases if and when they appear. The folded garment will thus be uniformly and neatly folded without wrinkles or creases, so as to be substantially wrinkle-free when it is ultimately unfolded for wearing. In addition, the apparatus permits any number of garments to be properly folded to the same uniform size and shape, making storage and/or stacking of the garments neat and orderly.

Figure 2:
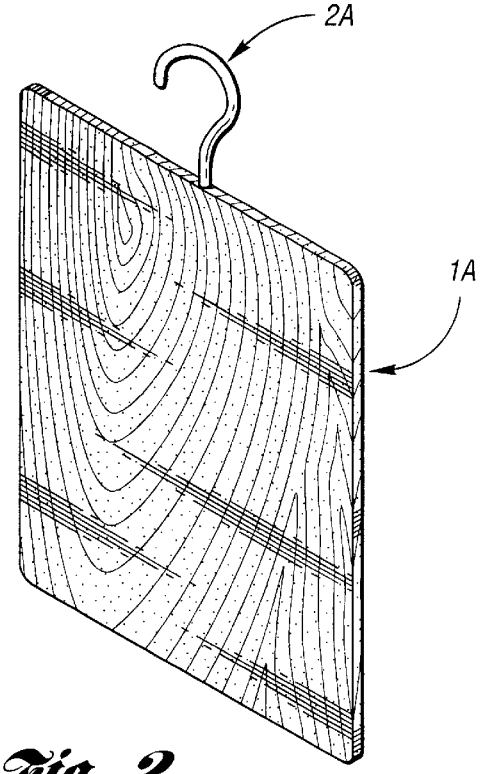
FIG. 2 is a perspective view of a garment folding apparatus in accordance with a second embodiment of the invention.

In the alternative embodiment of the invention shown in FIG. 2, main body portion 1A is fabricated of a wood material, preferably aromatic cedar. The supporting portion 2A may, for example, be made of a brass plated or similar metal material. If desired, supporting portion 2A may alternatively be made of the same material as main body portion 1A, e.g., cedar. The dimensions of main body portion 1A and supporting portion 2A are preferably substantially the same as described above with respect to the FIG. 1 embodiment, except that the thickness of the aromatic cedar forming main body portion 1A is desirably approximately ¼ inch.

The construction of the apparatus of FIG. 2 not only provides an aesthetically pleasing appearance, it also emits a desirable fragrance. In this respect, the aromatic cedar of main body portion 1A emits a pleasant aroma in the closet, laundry room or other area in which the apparatus is stored. Further, this same pleasant aroma may be imparted in a slight degree to the garment as it is folded around the apparatus.

It will be understood from the foregoing that the apparatus as depicted in FIGS. 1–4 is equally suitable for folding T-shirts, dress shirts, sweaters, sweatshirts, and similar garments. Further, it is contemplated that the dimensions and shape of main body portion 1 may be modified as desired to accommodate the folding of various sizes and types of garments. For example, the apparatus may be adapted for the folding of child-sized clothing by proportionally decreasing the dimensions of main body portion 1 or 1A, or may be adapted for folding extra large sized clothing by proportionally increasing such dimensions.

As described above, the overall size of the main body portion of the apparatus conforms generally to the ultimate folded dimension of the folded garment. In this respect, the width of the main body portion may be selected to permit the folded respective side portions of the garment to overlap, or not. For example, while it might be desired to permit the folded side portions of a T-shirt or similar garment to overlap, such overlapping may be less desirable where the garment to be folded is relatively bulky, such as a sweater or the like. For a bulky garment, it may be desired to provide the main body portion with a width dimension which permits the respective sides of the garment to be adjacent to each other when folded, but not overlapping.

While there have been described hereinabove what are at present considered to be the preferred embodiments of the invention, it will be understood that modifications may be made therein without departing from the spirit and scope of the invention. The present embodiments are therefore to be considered in all respects as illustrative, and not restrictive. The scope of the invention is indicated by the appended claims rather than by the foregoing description.

I claim:

1. A removable garment folding apparatus which is completely removed from the garment after the garment has been folded, comprising:

a main body portion shaped and dimensioned to conform to a desired folded dimension of a garment to be folded, said main body portion having a flat, rectangular shape;

said main body portion being fabricated of a substantially rigid material;

means for supporting said apparatus without said garment when said removable garment folding apparatus is not in use, said supporting means extending from an upper end of said main body portion;

said main body portion comprising a pair of side fold-guiding edge portions, a bottom fold-guiding edge portion, and a centering mark;

said side fold-guiding edge portions being defined by opposite side edges of said main body portion which are smooth and continuous along their entire lengths and which are parallel to one another;

said smooth, parallel side fold-guiding edge portions being freely slidable relative to garment portions folded thereover to permit free sliding disengagement and complete removal of said apparatus from the garment folded thereon;

said main body portion being adapted to be centered relative to said garment to be folded by aligning said centering mark with the center of the collar of said garment to be folded;

said main body portion being adapted to have said garment folded only over said smooth, parallel side fold-guiding edge portions and said bottom fold-guiding edge portion; and said apparatus being completely removed from said garment after folding operations are complete by upwardly pulling said apparatus free from the folded garment.

2. A garment folding apparatus according to claim 1, wherein:

said main body portion and said supporting means are integrally molded from a thermoplastic material.

3. A removable garment folding apparatus according to claim 1, wherein:

said supporting means comprises a hook-shaped member adapted to support said apparatus in a hanging position without said garment when said garment folding apparatus is not in use, said hook-shaped member being substantially the shape and dimension of a conventional hanger hook.

4. A garment folding apparatus according to claim 1, wherein:

said main body portion is fabricated of aromatic cedar.

5. A removable garment folding apparatus according to claim 3, wherein:

said hook-shaped member is made of a metal material.

6. A removable garment folding apparatus according to claim 1, wherein:

said bottom fold-guiding edge portion is shorter than each of said side fold-guiding edge portions.

7. A removable garment folding apparatus which is completely removed from the garment after the garment has been folded, comprising:

a main body portion shaped and dimensioned to conform to a desired folded dimension of a garment to be folded, said main body portion having a flat, rectangular shape;

said main body portion being fabricated of a substantially rigid material;

said main body portion comprising a pair of side fold-guiding edge portions, a bottom fold-guiding edge portion, and a centering mark;

said side fold-guiding edge portions being defined by opposite side edges of said main body portion which are smooth and continuous along their entire lengths and which are parallel to one another;

said main body portion being adapted to be centered relative to said garment to be folded by aligning said centering mark with the center of the collar of said garment to be folded;

said main body portion being adapted to have said garment folded only over said smooth, parallel side fold-guiding edge portions and said bottom fold-guiding edge portion;

said smooth, parallel side fold-guiding edge portions being freely slidable relative to garment portions folded thereover to permit free sliding disengagement and complete removable of said apparatus from the garment folded thereon; and said apparatus being completely removed from said garment after folding operations are completed by upwardly pulling said apparatus free from the folded garment.

8. A removable garment folding apparatus according to claim 7, wherein:

said main body portion is molded from a thermoplastic material.

9. A removable garment folding apparatus according to claim 7, wherein:

said main body portion is fabricated of aromatic cedar.

10. A removable garment folding apparatus according to claim 7, wherein:

said bottom fold-guiding edge portion is shorter than each of said side fold-guiding edge portions.

11. A removable garment folding apparatus according to claim 7, wherein:

the entire apparatus comprises a one-piece unitary member fabricated from only one material.

12. A removable garment folding apparatus according to claim 10, wherein:

the entire apparatus comprises a one-piece unitary member fabricated from only one material.

13. A removable garment folding apparatus which is completely removed from the garment after the garment has been folded leaving a uniformly-folded garment, comprising:

a main body portion which is flat and rectangular in shape;

said main body portion being fabricated of a substantially rigid material;

said main body portion comprising a pair of side fold-guiding edge portions, a bottom fold-guiding edge portion, a top edge portion, and a centering mark;

said side fold-guiding edge portions being defined by opposite side edges of said main body portion which are smooth and continuous along their entire lengths and which are parallel to one another;

said top edge portion being disposed perpendicular to said side edge portions;

said main body portion being adapted to be centered relative to a garment to be folded by aligning said centering mark with the center of the collar of said garment to be folded;

said main body portion being adapted to have said garment folded only over said side edge portions and said bottom edge portion, and not over said top edge portion;

said side edge portions being freely slidable relative to garment portions folded thereover to permit free sliding disengagement and complete removable of said apparatus from the garment folded thereon; and said apparatus being completely removed from said garment after folding operations are completed by upwardly pulling said apparatus free from the folded garment leaving a uniformly-folded garment.

14. A removable garment folding apparatus according to claim 13, wherein:

said main body portion is molded from a thermoplastic material.

15. A removable garment folding apparatus according to claim 13, wherein:

said main body portion is fabricated of aromatic cedar.

16. A removable garment folding apparatus according to claim 13, wherein:

said bottom fold-guiding edge portion is shorter than each of said side fold-guiding edge portions.

17. A removable garment folding apparatus according to claim 13, wherein:

the entire apparatus comprises a one-piece unitary member fabricated from only one material.

18. A removable garment folding apparatus according to claim 16, wherein:

the entire apparatus comprises a one-piece unitary member fabricated from only one material.

19. A removable garment folding apparatus according to claim 16, including:

means for supporting said apparatus without said garment when said removable garment folding apparatus is not in use; said supporting means extending from said top edge portion; and said supporting means having a thickness which is no greater than the thickness of said main body portion.

* * * * *